US009410686B2

(12) United States Patent
Burmeister et al.

(10) Patent No.: US 9,410,686 B2
(45) Date of Patent: Aug. 9, 2016

(54) COOLING SYSTEM AND LED-BASED LIGHT COMPRISING SAME

(75) Inventors: Jens Burmeister, Eberbach (DE); Gerhard Schwarz, Schönbrunn (DE)

(73) Assignee: COOPER CROUSE-HINDS GMBH, Soest (DE)

( * ) Notice: Subject to any disclaimer, the term of this patent is extended or adjusted under 35 U.S.C. 154(b) by 112 days.

(21) Appl. No.: 14/124,557

(22) PCT Filed: Jun. 8, 2012

(86) PCT No.: PCT/EP2012/002445

§ 371 (c)(1), (2), (4) Date: May 28, 2014

(87) PCT Pub. No.: WO2012/167945

PCT Pub. Date: Dec. 13, 2012

(65) Prior Publication Data

US 2014/0268827 A1 Sep. 18, 2014

(30) Foreign Application Priority Data

Jun. 8, 2011 (DE) ..... 10 2011 103 605

(51) Int. Cl.
*F21V 29/00* (2015.01)
*F21V 29/02* (2006.01)
(Continued)

(52) U.S. Cl.
CPC ..... *F21V 29/022* (2013.01); *F21K 9/10* (2013.01); *F21V 15/01* (2013.01); *F21V 25/12* (2013.01);
(Continued)

(58) Field of Classification Search
CPC ..... F21V 29/004; F21V 29/70; F21V 29/83; F21V 29/507; F21V 29/773; F21V 29/763; F21V 23/009; F21V 29/02; F21V 29/74; F21V 23/006; F21V 15/01; F21V 29/2212; F21V 29/677; F21V 29/75; F21V 29/77
USPC ..... 362/373
See application file for complete search history.

(56) References Cited

U.S. PATENT DOCUMENTS

2004/0120152 A1* 6/2004 Bolta et al. ..... 362/294
2010/0134017 A1* 6/2010 Yatsuda et al. ..... 315/113
2010/0296285 A1* 11/2010 Chemel et al. ..... 362/235

FOREIGN PATENT DOCUMENTS

AU 2009210391 A1 3/2010
CN 2641452 9/2004
(Continued)

OTHER PUBLICATIONS

Peter Huber, DE Application No. 102011103605.2 German Office Action, Mar. 12, 2012, 5 pages, Deutsches Patent- und Markenamt.
(Continued)

*Primary Examiner* — William Carter
(74) *Attorney, Agent, or Firm* — King & Spalding LLP

(57) ABSTRACT

A cooling system (1) of a light-emitting diode-based light (2) is proposed, wherein said light comprises a completely closed light fitting (3) with a flame-proof housing (4). In the housing, a cooling body (5) as part of the cooling system (1) is arranged. The cooling system (1) further comprises an electrically operated air circulation means (6).
By such a cooling system, it is possible to compensate reduction in light flux with minimal additional costs or minimal additional weight or size of the light, wherein the LED light is simultaneously usable in hazardous areas in a wide temperature range.

16 Claims, 2 Drawing Sheets

(51) Int. Cl.

| | |
|---|---|
| ***F21K 99/00*** | (2016.01) |
| ***F21V 15/01*** | (2006.01) |
| ***F21V 25/12*** | (2006.01) |
| ***F21V 29/65*** | (2015.01) |
| ***F21V 29/67*** | (2015.01) |
| ***F21V 29/74*** | (2015.01) |
| *F21V 23/04* | (2006.01) |
| *F21Y 101/02* | (2006.01) |

(52) U.S. Cl.

CPC ..... *F21V 29/65* (2015.01); *F21V 29/673* (2015.01); *F21V 29/677* (2015.01); *F21V 29/74* (2015.01); *F21V 23/0442* (2013.01); *F21Y 2101/02* (2013.01)

(56) References Cited

FOREIGN PATENT DOCUMENTS

| | | | |
|---|---|---|---|
| CN | 101995009 | | 3/2011 |
| DE | 202010002251 | U1 | 7/2010 |
| DE | 102009019226 | A1 | 11/2010 |
| DE | 202008017960 | U1 | 3/2011 |
| DE | 102009060434 | A1 | 6/2011 |
| EP | 2312202 | | 4/2011 |
| GB | 2465493 | A | 5/2010 |
| JP | 2000133002 | | 5/2000 |
| JP | 2010-192406 | | 9/2010 |
| JP | 2011086621 | | 4/2011 |
| WO | 2008092271 | A1 | 8/2008 |

OTHER PUBLICATIONS

Peter Huber, DE Application No. 102011103605.2 German Office Action, Mar. 13, 2013, 5 pages, Deutsches Patent- und Markenamt.

Sally Arsac England, PCT/EP2012/002445 International Search Report, Nov. 8, 2012, 2 pages, European Patent Office.

Japanese Patent Office, Office Action issued in Japanese patent application No. 2014-513947, mailing date Nov. 25, 2015, 6 pages, translation 6 pages, Japanese Patent Office.

Machine generated translation of JP 2000133002, via Japan Platform for Patent Information (J-Plat Pat), 13 pages.

Machine generated translation of JP 2010-192406, via Japan Platform for Patent Information (J-Plat Pat),11 pages.

The State Intellectual Property Office of People's Republic of China, Office Action issued in Chinese patent application No. 201280038304.6, Dec. 1, 2015, 8 pages, translation 8 pages, The State Intellectual Property Office of People's Republic of China.

Machine generated translation of CN2641452Y, via Lexis Nexis Total Patent, 2 pages.

Machine generated translation of CN101995009A, via Lexis Nexis Total Patent, 3 pages.

Machine generated translation of JP2011086621, via Lexis Nexis Total Patent, 14 pages.

* cited by examiner

COOLING SYSTEM AND LED-BASED LIGHT COMPRISING SAME

RELATED APPLICATIONS

This application is a Section 371 national phase application of and claims priority to PCT application PCT/EP2012/002445 filed on Jun. 8, 2012, which claims priority to German Patent Application Number 10 2011 103 605.2 filed on Jun. 8, 2011, the contents of which are incorporated herein in their entirety.

BACKGROUND

In the last time a number of illuminaires, or lights, used in hazardous areas were proposed, in which incandescent light sources or fluorescent light sources are replaced by light emitting diodes (LEDs). Such new light sources also have to meet the particular requirements for arranging such lights in hazardous areas, like a flameproof enclosure, or other requirements involved with explosion protected product like Ex-e, Ex-d and the like. Moreover, the light output of such LED light sources depends on the temperature and it might generally be said that any rise of ambient temperature from, for example, 20° C. to 90° C. will reduce the light flux from 100% to 50%. Therefore, cooling systems are necessary for such LED light sources which compensate the reduction in light flux. Also such cooling systems have to fulfil the requirements already mentioned above for the usage in hazardous areas.

One possibility to compensate the reduction in light flux, is to increase the cooling capacity of the complete fixture and corresponding housing of the light to at least partly compensate such reduction of light flux by increasing a contact surface with respect to the ambient atmosphere. Another possibility is to add some LEDs that are used in case there is a corresponding reduction in light flux.

However, those solutions will result in an increase of cost and also of size of the corresponding light or light fitting.

SUMMARY

It is an object of the present invention to compensate the reduction in light flux with minimal additional costs or minimal additional weight or size of the light wherein simultaneously the LED light should be usable in hazardous areas in a wide temperature range.

This object is solved by the features of the independent claims.

According to the invention, a cooling system of a corresponding LED light does not only comprise a cooling body as part of the cooling system, wherein such cooling body is arranged within a flameproof housing, but further comprises an electrically operated air circulation means.

By this air circulation means, it is possible to forcibly circulate air and to sufficiently dissipate heat from the LED light by such circulated air to avoid any reduction in light flux which might result from an increase of the temperature.

Of course also this electrically operated air circulation means has to fulfil the requirements of operating same in hazardous areas. One simple possibility for realizing such air circulation means is such a means which comprises at least one cooling fan.

To use the particular explosion proof properties of the light it is also possible to arrange the air circulation means within the flameproof housing. This means that no additional precautionary measures have to be taken in view of hazardous areas but corresponding measures already fulfilled by the light are used.

One possibility for flame-proof housing is for example an ex-d enclosure, which provides an explosion-proof housing.

Generally, not only one LED light source is used, but quite a number of same. In this respect it is advantageous, if the LED-based light comprises at least a LED-module with a LED-board including a printed circuit board and multiple LEDs. Such corresponding modules can also replace a number of other light sources, as for example 2 or 3 florescent lamps or incandescent lamps.

Furthermore, corresponding modules are available in different forms and sizes and generally the corresponding LEDs are directly provided on such a printed circuit board (PCB). It is also possible to directly use corresponding terminals for electrically connecting such a LED-board with the terminals to replace a former incandescent or florescent lamp.

To dissipate heat directly from the LED-board, it is also possible that this is in contact with the cooling body which comprises for example a number of cooling ribs. It is also possible that the cooling body and the board are a one-part construction to be arranged within the light.

To obtain an effective airflow with respect to the LEDs it can be considered as advantageous if the air circulation means is arranged in an opening of the LED-board and/or the cooling body. Via this air circulation means, air will be circulated within the flameproof housing such that heat is not only transferred to the wall of the housing by the cooling body and its cooling ribs, but also by the increased airflow within the housing. The air circulation means could also be arranged at an other position within the housing, for example within the air circulation chamber.

Furthermore, the airflow will also better dissipate heat from the LEDs to the cooling body and its ribs.

To obtain a rather big surface for such heat dissipation, it might be proposed that an air circulation chamber is formed around the LED-board and the cooling body. This allows an airflow contacting nearly all of the corresponding inner surface of the housing.

It might be necessary to arrange the fan at a particular position for optimizing the cooling effect and in this respect it is then advantageous when the fan of the air circulation means is separated from a corresponding fan motor with a mechanical torque transmission means there between. This allows a separate arrangement of fan motor and fan. Such mechanical torque transmission means can be a rotation axis, a spindle drive or the like. It is of course also possible to assign the corresponding fan motor to two or more fans within the housing.

Furthermore, it is also possible to arrange the fan motor within the flameproof housing and at least one fan is assigned to an outer housing, which at least partially covers the flameproof housing with an air guiding means there between.

This means that the fan is arranged outside the flameproof housing and only has to fulfill certain mechanical requirements concerning the arrangement in hazardous areas. However, all electrical requirements are still fulfilled by the flameproof housing and the elements arranged therein.

To improve the cooling with such an outer fan and an outer housing it might be considered that a number of cooling ribs extend between an outer surface of the flameproof housing and the outer housing and are in particular provided within the air guiding means. The outer housing is also used for protecting the cooling ribs against pollution by dust or the like.

One simple possibility for realizing such air guiding means is an air guiding means formed by an air guiding channel which is open at both channel ends for guiding air there through.

Such an air guiding channel might be sufficient for cooling all of the LEDs within the flameproof housing, such that additional cooling means within the housing might not be necessary. However, it is of course also possible to combine such exterior cooling means with further interior cooling means as already mentioned above.

To provide an effective airflow within the air guiding means, the outer fan could be arranged near or at one channel end.

It is feasible that the mechanical torque transmission means extends through the air guiding channel from the fan motor, which is arranged within the flameproof housing, to the outer fan, which is arranged within the air guiding channel.

As already outlined, also a combination of interior and exterior cooling is possible, according to which a further inner fan might be arranged within the flameproof housing in addition to the outer fan. Of course, also more than these inner and outer fans may be provided like for example two outer fans or two inner fans or any other combination of fans.

In general, it might be possible to use only one fan motor which means that the inner and outer fans are both actuated by the same fan motor within the flameproof housing.

It is of course also possible that depending on the time of actuation, the fans will also produce heat such that it might be advantageous if the corresponding fan is supported by the cooling ribs or is arranged between the cooling ribs. This is also possible in view of the fan motor, which might be supported or at least be in contact with such cooling ribs.

Generally, it will take some time after switching on the corresponding light until a temperature range is reached which might result in a particular reduction of light flux. Furthermore, it is of course possible that the ambient temperature is quite low which will influence any cooling of the light. To operate the fans only in the case that they are really needed, at least one temperature sensor may be arranged within the flameproof housing to control the actuation and/or speed of the fan. This temperature sensor can be arranged quite close to the LED-module. With such a temperature sensor not only the switching on and off of the fan motor is controlled, but also the speed of the fan can be influenced in case some stronger or weaker airflow is required.

Furthermore, any required power to operate the fan can be minimized in case this particular part of the cooling system is only switched on if necessary.

The particular cooling system might by an additional part that can be incorporated also in lights or luminaires which are already in use. This particular cooling system can also be arranged within such a light or luminaire in case for example any incandescent or fluorescent light source is replaced by such a LED-module. This means that the cooling system is a replacement part or an additional part which like a module can be incorporated in a light or luminaire.

Moreover, as it is also possible that this cooling system is part of a corresponding light or luminaire, the present application is also directed to a LED-based light comprising a completely closed light fitting with a flameproof housing and a cooling system as mentioned above.

Exemplary embodiments of the invention will be described in detail with reference to the accompanying drawings herein after.

DETAILED DESCRIPTION

Figure 1:
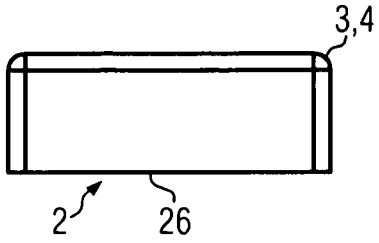
In FIG. 1 there is a side view of the LED-based light.

In FIG. 1 there is a side view of one LED-based light 2 with a light fitting 3 including a flameproof housing 4. At the lower end of the housing there is a cover glass 26 such that the light fitting is completely closed.

Figure 2:
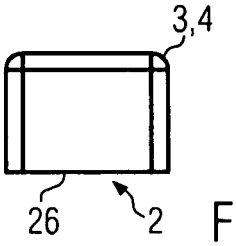
In FIG. 2, a lateral view of the light according to FIG. 1.
Figure 3:
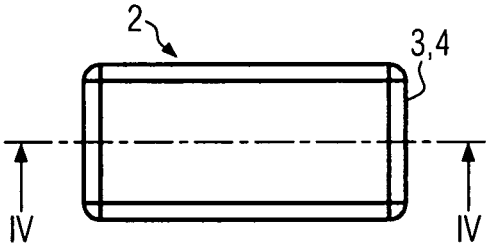
In FIG. 3, a top view of the light according to FIG. 1.

In FIG. 2 there is a further side view of the corresponding light 2 from one lateral end and in FIG. 3 there is a top view of the same light.

In general, the housing according to this first embodiment is box-shaped.

Figure 4:
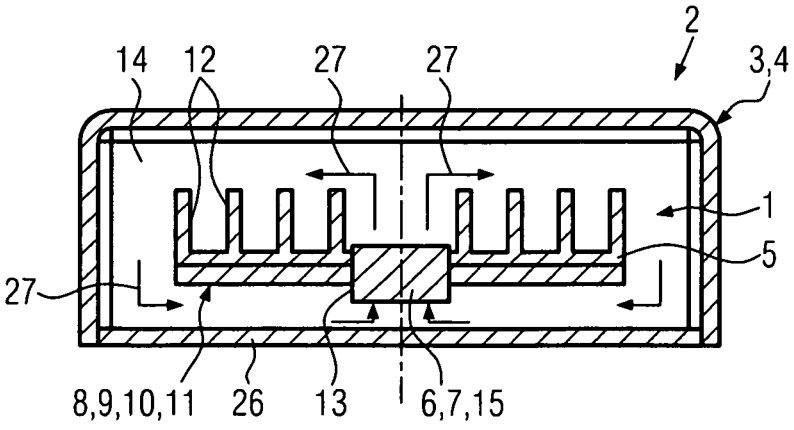
In FIG. 4, a cross section along the line IV-IV of FIG. 3.

In FIG. 4 there is a cross section of the corresponding housing along line IV-IV according to FIG. 3.

In the interior of the flameproof housing 4 an air circulation chamber 14 is provided which surrounds a cooling system 1 according to the present invention. This cooling system 1 comprises a cooling body 5 with a number of cooling ribs 12 extending to the upper wall of the housing, which is opposite to corresponding cover glass 26. Below the cooling body 5 a LED-module 8 is arranged which has in general the same length of the cooling body 5 and is attached to same. It is also possible that the LED-module 8 is formed together with the cooling body 5 as an integrated part.

The LED-module 8 comprises at least one LED-board 9 which is generally a printed circuit board 10. On this printed circuit board (PCB) a number of LEDs 11 are arranged. The arrangement may be in a number of strips or the like and it is also possible that some other pattern of LEDs is arranged on this PCB 10.

The LEDs 11 emit light in direction to the cover glass 26. In the middle of the PCB 10 and also the cooling body 5, an opening 13 is arranged. In this opening, an air circulation means 6 as part of the cooling system 1 is arranged. The air circulation means 6 comprises a cooling fan 7, which can be considered as an inner fan as it is arranged inside the flameproof housing 4. Moreover, the air circulation means 6 also comprises some fan motor 15.

In case the cooling fan 7 is rotated by its fan motor 15, air will forcibly circulate within the flameproof housing and in particular within the air circulation chamber 14, see corresponding air flow direction 27.

Via this airflow, heat generated by the LEDs will be dissipated such that an overall cooling effect of the light is enhanced.

The airflow will prevent any localized heating of one or some LEDs and will also provide a more general distribution of the heat with respect to the cooling body and its ribs and also in view of the outer wall of the housing.

As the light according to the present application is arranged in hazardous areas, corresponding requirements concerning the arrangement of such electrical devices in those areas have to be met, like for example that the flameproof housing is an ex-d enclosure.

Figure 5:
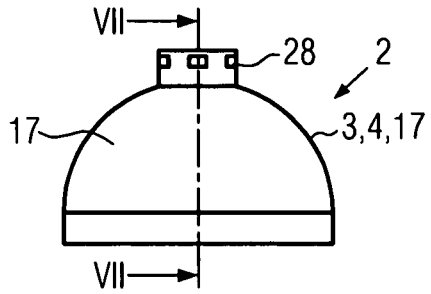
In FIG. 5, a side elevational view of a second embodiment of a light.
Figure 6:
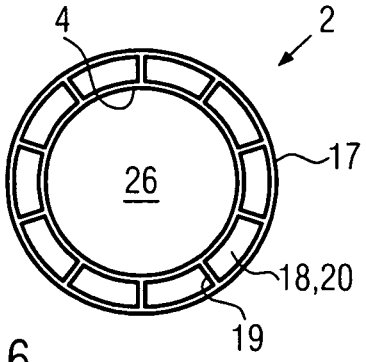
In FIG. 6, a bottom view of the light according to FIG. 5.
Figure 7:
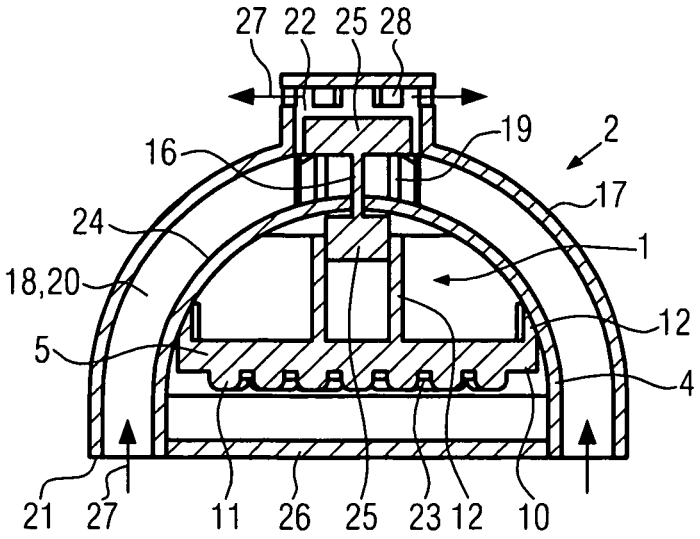
In FIG. 7, a cross section along the line VII-VII of FIG. 5.

In FIGS. 5 to 7, a second embodiment of a corresponding cooling system according to the invention is disclosed. FIG. 5 is a side elevational view of a LED-based light 2 and FIG. 6 is a bottom view of this light.

The corresponding flameproof housing or light fitting 3 according to this embodiment is dome-shaped and comprises an inner housing, see flameproof housing 4, and an outer housing 17, see in particular FIGS. 6 and 7. The inner or flameproof housing is again a completely closed fitting in which the LED-module 8 is arranged together with a cooling body 5. According to FIG. 7, cooling body 5 and LED-module 8 are integrated wherein a number of cooling ribs 12 as part of the cooling body 5 extend in a vertical direction upwards.

Corresponding LEDs 11 with a PCB are arranged on a bottom surface of the cooling body 5 and are directed to corresponding cover glass 26.

Between the flameproof housing 4 and the outer housing 17, an air guiding means 18 in the form of an air guiding channel 20 is provided. This air guiding channel 20 is open at its ends, see channel ends 21 and 22.

According to FIG. 6, the air guiding channel 20 is subdivided by a number of cooling ribs 19. Those extend from an outer surface 24 of the flameproof housing 4 through the air guiding channel 20 and up to an interior surface of the outer housing 17.

In the second embodiment according to FIGS. 5 to 7 the air circulation means 6 comprises a fan motor 15 which is separated from a corresponding fan, see outer fan 25. Between the motor and the outer fan 25 there is a mechanical torque transmission means 16. Such a means can be a rotational axis, a spindle or the like.

The corresponding mechanical torque transmission means 16 extends through the air guiding channel 20, wherein the fan motor 15 is arranged within the flameproof housing 4 and the outer fan 25 is arranged within the air guiding channel 20 near its channel end 22.

At this channel end 22 the outer housing 17 has a number of openings 28 such that the air flow is directed from the lower channel ends 21 to this upper channel end 22 and through the corresponding openings 28 to the ambient atmosphere.

The corresponding mechanical torque transmission means 16 is a mere mechanical connection which should fulfil corresponding mechanical requirements concerning the arrangement in hazardous areas.

However, the corresponding electric parts of the air circulation means 6 are all arranged within the flameproof housing 4 or the completely closed light fitting 3.

Some further particular cooling ribs 19 are arranged below the outer fan 25 which is supported by those ribs, see FIG. 7, wherein also the fan motor 15 is arranged between corresponding cooling ribs 12 inside the housing 4.

In all of the embodiments according to the present invention, it is possible to arrange a temperature sensor 23 inside the flameproof housing and generally adjacent to the LED-module 8 or corresponding LEDs 11. By this temperature sensor 23 the temperature near the LEDs is measured and any actuation of the fans can be controlled in compliance with the measured temperature. This means that only in case the temperature is increased within the flameproof housing above a particular level, a corresponding fan motor 15 is switched on to provide some cooling in addition to the cooling already provided by the cooling body and its cooling ribs.

Furthermore, also the speed of the fan can be controlled in dependence of the measured temperature such that in case the temperature further rises also the speed is increased and vice versa.

Moreover, it is also possible to additionally arrange an inner cooling fan 7, see for example FIG. 3. This inner fan can be arranged as illustrated in FIG. 3 or may also be connected to the fan motor 15 by a corresponding mechanical torque transmission means 16. It is possible to actuate each of such two fans separately depending on the measured temperature.

According to the present application, a cooling system is provided which is very effective in view of the transfer of heat from a source, see LEDs, to the wall of the enclosure and to distribute the heat in a better way with respect to the cooling body and its ribs. Such a cooling system can comprise an inner and/or outer fan.

Generally, an increased airflow within the enclosure or also around the enclosure is provided wherein the cooling system may only be used if required.

Furthermore, the present invention is also directed to such a LED-based light with corresponding cooling systems as discussed above.

The invention claimed is:

1. An LED-based light with at least a cooling system and a number of LEDS, said light comprising a completely closed light fitting with a flame proof housing that is an ex-d enclosure, in which a cooling body as a part of the cooling system is arranged, wherein the cooling system further comprises an electrically operated air circulation means arranged within the flameproof housing, the air circulation means comprising at least a cooling fan, the cooling fan separated from a fan motor, wherein the fan motor is arranged within the ex-d enclosure.

2. The LED-based light according to claim 1, wherein the LED-based light comprises at least a LED-module with a LED-board including a printed circuit board (PCB) and multiple LEDs.

3. The LED-based light according to claim 2, wherein the LED-board is in contact with the cooling body comprising a number of cooling ribs.

4. The LED-based light according to claim 2, wherein the air circulation means is arranged in an opening of the LED-board and/or cooling body.

5. The LED-based light according to claim 2, wherein an air circulation chamber is formed around the LED-module and the cooling body within the housing.

6. The LED-based light according to claim 1, wherein the cooling fan of the air circulation means is separated from the fan motor with a mechanical torque transmission means therebetween.

7. The LED-based light according to claim 6, wherein the cooling fan is assigned to an outer housing as an outer fan, which outer housing at least partially covers the flameproof housing with an air guiding means therebetween.

8. The LED-based light according to claim 7, wherein a number of cooling ribs extend between an outer surface of the flameproof housing and the outer housing and are provided within the air guiding means.

9. The LED-based light according to claim 7, wherein the air guiding means is formed by an air guiding channel which is open at both channel ends for guiding air therethrough.

10. The LED-based light according to claim 7, wherein the outer fan is arranged near or at one channel end.

11. The LED-based light according to claim 7, wherein the outer fan is supported by cooling ribs.

12. The LED-based light according to claim 6, wherein the mechanical torque transmission means extends through the air guiding channel from the fan motor within the flameproof housing to the outer fan within the air guide channel.

13. The LED-based light according to claim 6, wherein the fan motor is in contact with cooling ribs.

14. The LED-based light according to claim 1, wherein an inner fan is arranged within the flameproof housing.

15. The LED-based light according to claim 1, wherein an inner fan is also actuated by a fan motor of the cooling fan.

16. The LED-based light according to claim 1, wherein at least one temperature sensor is arranged within the flame-proof housing to control actuation and/or speed of the cooling fan.

* * * * *